United States Patent [19]

Murphy

[11] 4,395,966

[45] Aug. 2, 1983

[54] BOAT HULL SCRUBBER

[76] Inventor: Kent L. Murphy, 3407 Harmony, Troy, Mich. 48084

[21] Appl. No.: 288,643

[22] Filed: Jul. 30, 1981

[51] Int. Cl.[3] ..... B63B 59/08

[52] U.S. Cl. ..... 114/222; 15/222

[58] Field of Search ..... 15/1.7, 210 R, 222, 15/209 C; 114/222

[56] References Cited

U.S. PATENT DOCUMENTS

| | | | |
|---|---|---|---|
| Re. 13,652 | 11/1913 | Frazier | 114/222 |
| 676,926 | 6/1901 | Stump . | |
| 959,566 | 5/1910 | MacDonald | 114/222 |
| 2,737,679 | 3/1956 | Choma | 15/222 |
| 3,010,420 | 11/1961 | Glynn | 114/222 |
| 3,709,184 | 1/1973 | Laney | 114/222 |
| 4,355,067 | 10/1982 | Neuveu | 15/209 C |

*Primary Examiner*—Trygve M. Blix
*Assistant Examiner*—Ivy M. Shum
*Attorney, Agent, or Firm*—Barnes, Kisselle, Raisch, Choate, Whittemore & Hulbert

[57] ABSTRACT

A device for scrubbing algae and other marine growth from boat hulls comprising a one-piece belt of fibrous fluorocarbon abrasive material and a plurality of floats mounted along the belt undersurface. A number of the floats are of oval cross section and are mounted to pivot at right angles to the belt longitudinal dimension. As the belt is drawn in the direction of its length back and forth beneath a hull, the floats urge the belt into frictional scrubbing contact with the hull surface. The pivotal floats operate synergistically to combine buoyant forces and water drag forces to provide enhanced scrubbing contact with surface irregularities such as stabilization chimes.

5 Claims, 5 Drawing Figures

BOAT HULL SCRUBBER

The present invention is directed to devices for removing algae and other marine growth from boat hulls, particularly fiberglass boat hulls.

An object of the invention is to provide a device for removing algae and marine growth from a boat hull, particularly a fiberglass boat hull, which device is inexpensive and may be put into use by an operator without the necessity that the operator enter the water as with conventional brushes or the like.

Another and more specific object of the invention is to provide a device of the described type which is particularly well adapted for use on sport or ski boats of the type having irregularities on the hull under surface, such as for the purpose of stabilizing the hull during high-speed operation.

The invention, together with additional objects, features and advantages thereof, will be best understood from the following description, the appended claims and the accompanying drawings in which:

Figure 1:
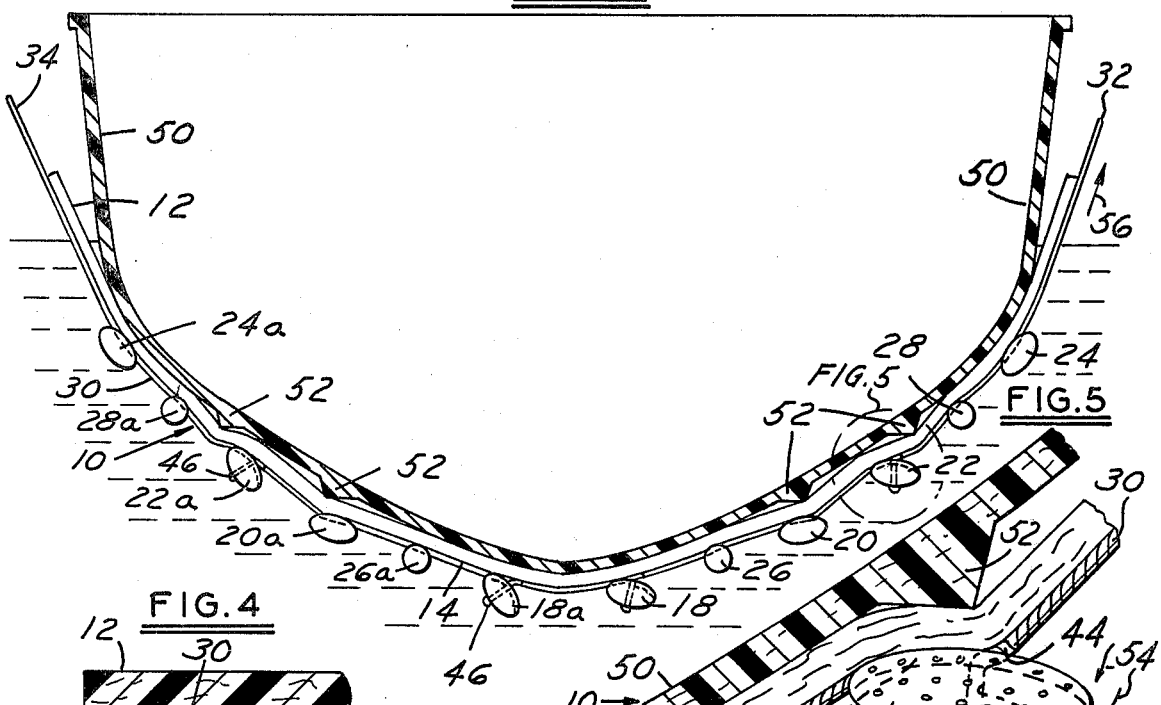
FIG. 1 is an elevational view of the scrubbing apparatus in accordance with the invention in use on a fiberglass boat hull, the latter being illustrated in essentially schematic cross section.

The drawing illustrates a presently preferred embodiment 10 of a hull scrubbing device in accordance with the invention as comprising an elongated generally rectangular one-piece belt 12. Belt 12 has a thickness which is small as compared with its width and length, and is constructed of coarse fluorocarbon resin fibrous abrasive material so as to be highly flexible both widthwise and lengthwise of the belt. One example of a suitable belt material is a "plastic wool" conventionally marketed for household cleaning purposes.

Figure 2:
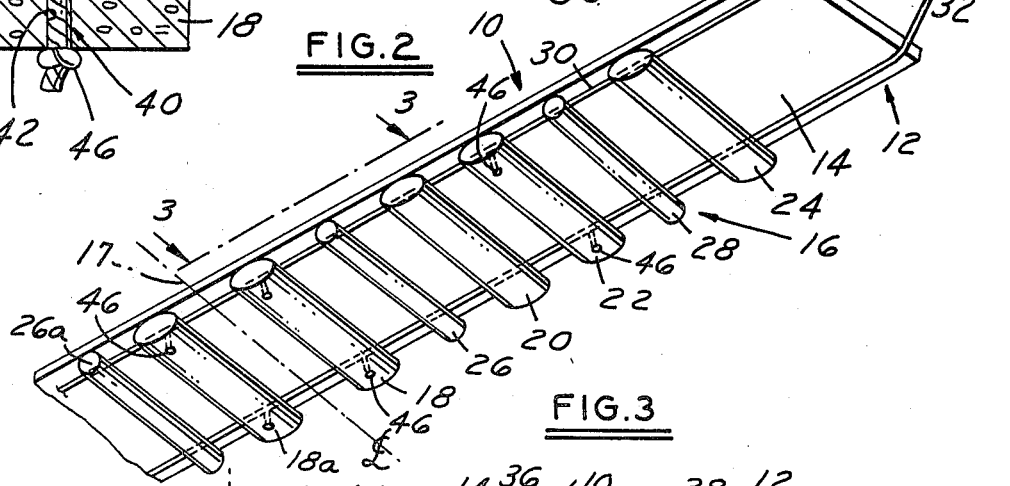
FIG. 2 is a fragmentary perspective view of the hull scrubber in accordance with the invention.

A plurality of floats of styrofoam or other suitable buoyant material are mounted along the under or non-scrubbing face 14 of belt 12 in an equally spaced linear array 16. As best seen in FIG. 2, each float in array 16 extends bodily entirely across the width of belt 12 and has an axis which is perpendicular to the longitudinal belt dimension. In the particular embodiment shown in the drawings, array 16 includes on one side of belt longitudinal centerline 17 (FIG. 2) four floats 18, 20, 22, 24 of generally oval cross section, and a pair of floats 26, 28 of circular cross section respectively positioned between first and second oval floats 18, 20 and third and fourth oval floats 22, 24. Floats **18*a*–28*a* are complimentarily positioned on the opposing side of centerline 17 and are respectively identical with floats 18–28. A rope 30 of hollow nylon braid, for example, is looped along one longitudinal edge of belt 12 on underface 14 and then along the opposite edge, with the loop projecting from opposite ends of belt 12 as at 32, 34** for operating the device in the manner to be described.

Preferably, floats **20, 24–28, 20*a*, 24*a*–28*a* are fixedly adhered to belt undersurface 14 with float axes extending laterally of the belt longitudinal dimension as previously described. Rope loop 30 is likewise adhered to belt undersurface 14, suitable channels or grooves 36,38 being formed in each float adjacent the ends for receiving rope loop 30 so that the face of each float engages (and is adhered to) the scrubber belt. On oval floats 20, 24 20*a*, 24*a*, faces of larger radius of curvature are adhered to belt 12. Rope 30 and floats 20, 24–28, 20*a* and 24*a*–28*a* may be fastened to belt 12** by any suitable chemical or other permanent and water-resistant adhesive technique.

Figure 5:
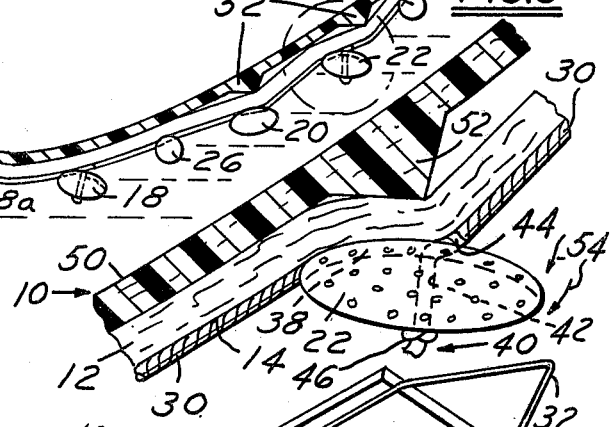
FIG. 5 is a fragmentary view on an enlarged scale of that portion of FIG. 1 encircled by the line 5—5.
Figure 4:
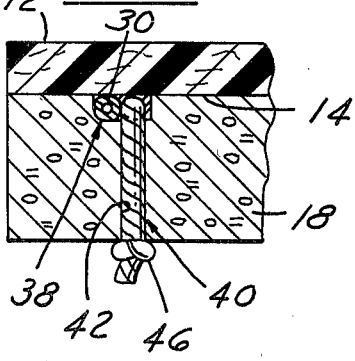
FIG. 4 is a fragmentary sectional view taken along the line 4—4 in FIG. 3.
Figure 3:
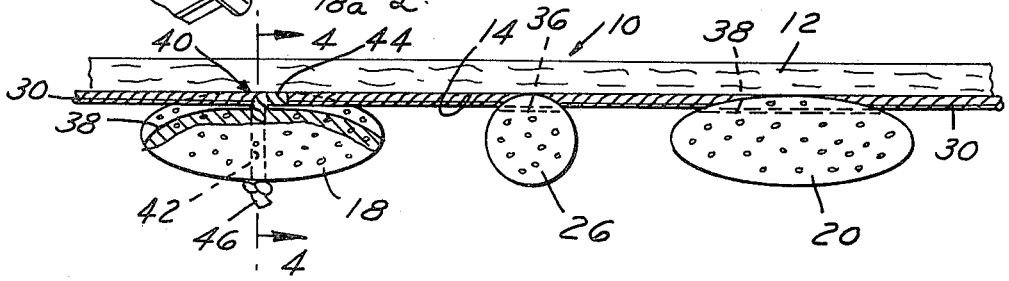
FIG. 3 is a fragmentary elevational view on an enlarged scale taken generally along the line 3—3 in FIG. 2.

In accordance with an important feature of the invention, oval floats **18, 22, 18*a* and 22*a* are mounted to pivot in the longitudinal direction with respect to belt undersurface 14. In the embodiment of the drawing, this is accomplished by passing a small rope length 40 through an opening 42 extending across the narrow float dimension adjacent each float end. Adjacent belt undersurface 14, the several rope lengths 40 are bent at right angles 44 (FIGS. 3 and 5) parallel to rope 30 and adhered to the belt and/or rope within float channel 38. The opposite end of each length 40 is knotted as at 46 for retaining floats 18, 18*a*, 22 and 22*a* snugly against belt undersurface 14. Thus, in accordance with an important feature of the invention, floats 18, 18*a*, 22 and 22*a* are free independently to rock or pivot with respect to the opposing undersurface 14 of belt 12**.

In use, the device 10 is placed beneath a boat hull 50 (FIG. 1) such that the upper or scrubbing surface of belt 12 engages the hull undersurface and rope loop ends 32, 34 project from respective belt ends out of the water on opposite sides of the boat hull. This may be accomplished by starting at the bow and working aft. The belt is then manually drawn back and forth across the boat hull undersurface. This back and forth action is repeated continuously while moving steadily aft. Upon reaching the stern, the device is withdrawn from the water. For severe cases, the process may be repeated several times.

It will thus be appreciated in accordance with the invention that buoyancy of the several floats functions to urge the belt uppersurface into enhanced frictional scrubbing contact with the hull surface. The described fluorocarbon abrasive belt material thereby achieves efficient cleaning of the boat hull without excessive effort on the part of the operators and without scratching fiberglass boat hulls for which the invention is particularly suited.

In accordance with the above-described particularly important feature of the invention, the non-circular cross section of floats **18, 22, 18*a*, 22*a* cooperates with the pivotal mounting thereof for urging the belt to follow irregularities in the hull undersurface, such as the hull chimes illustrated at 52. More specifically, water drag in the direction 54 (FIG. 5) as the belt is pulled in the direction 56 (FIG. 1) causes the forward edge of the pivotal floats (with reference to the pulling direction) to pivot downwardly, whereby the rearward float edges pivot upwardly to urge belt 12 against the back or left-hand surfaces of chimes 52** during passage thereover. When the pulling direction is reversed, the floats pivot in the opposite direction and catch the opposing or right-hand chime surfaces as viewed in the drawing. It has been found in testing a working embodiment of the invention that the device herein disclosed is effective to remove substantially all of the algae and other types of marine growth from the hull undersurface.

It will be understood that the particular construction and materials herein disclosed are given by way of example, and no undue limitations on the invention should be inferred therefrom. Likewise, other means for pivotally mounting floats 18, 18*a*, 22 and 22*a* are envisioned, such as tacks extending through the respective float cross sections and having barbed ends embedded in the belt material.

It is believed that the particular combination of float geometries herein disclosed—i.e. circular in the case of floats 26, 28, 26*a* and 28*a* and oval cross section for the remainder—is particularly advantageous. In particular, the geometry of all of the oval floats tends inherently to convert a portion of the pulling force into a scrubbing force through cooperation with water drag forces as previously described. This is accomplished even in the case of oval floats 20, 24, 20*a* and 24*a* adhered to the belt undersurface because of the relatively sharp float edge facing in the pulling direction. This inherent advantage of the oval float cross section is particularly enhanced by pivotal mounting of a portion of the floats since the edge of each float facing in the pulling direction is then free to separate from the belt. This operates both to urge the belt over irregularities in the hull surface as described, and to exert enhanced force against the belt as a combination of buoyant and drag forces.

The invention claimed is:

1. A device for scrubbing marine growth and the like from the submerged surface of boat hulls, especially fiberglass boat hulls of a type having surface irregularities extending lengthwise of the hull, said device comprising an elongated scrubbing belt having upper and lower faces and longitudinally spaced ends, and being constructed of abrasive material, at least the upper of said faces being flat and forming a scrubbing surface, float means constructed of buoyant material extending along and permanently secured to said lower face, and means projecting from said longitudinal ends of said belt and adapted to be grasped by an operator including a closed rope loop extending along opposite longitudinal edges of said belt through at least some of said float means and having loop ends projecting from said opposite longitudinal ends of said belt for manually drawing said belt in the direction of its length back and forth laterally beneath a boat hull with said upper face in engagement with the submerged hull surface, such that buoyant forces exerted by said float means on said belt urge said belt into scrubbing engagement with the submerged hull surface.

2. The device set forth in claim 1 wherein said float means comprises a plurality of floats disposed in a spaced array along said lower face longitudinally of said belt.

3. The device set forth in claim 2 wherein said floats comprise discrete bodies of buoyant material extending across the width of said belt, and wherein at least some of said floats are fixedly secured to said belt.

4. The device set forth in claim 2 wherein at least some of said floats are of oval cross section and are mounted to pivot with respect to said belt.

5. The device set forth in claim 1, 2, 3 or wherein said belt is constructed from a continuous length of fibrous fluorocarbon abrasive material.

* * * * *

UNITED STATES PATENT OFFICE
CERTIFICATE OF CORRECTION

PATENT NO. : 4,395,966
DATED : August 2, 1983
INVENTOR(S) : Kent L. Murphy

It is certified that error appears in the above-identified patent and that said Letters Patent are hereby corrected as shown below:

Column 4, Claim 5, Line 28, after "2" insert -- or --.

Column 4, Claim 5, Line 28, after "3" cancel "or".

Signed and Sealed this

First Day of November 1983

[SEAL]

*Attest:*

GERALD J. MOSSINGHOFF

*Attesting Officer*

*Commissioner of Patents and Trademarks*